US006425776B1

(12) United States Patent
Fredl

(10) Patent No.: US 6,425,776 B1
(45) Date of Patent: Jul. 30, 2002

(54) CIRCULAR PLUG AND SOCKET CONNECTOR FOR PRODUCING ELECTRICAL LINE CONNECTIONS

(75) Inventor: Sonja Fredl, Deggendorf (DE)

(73) Assignee: Interconnectron GmbH, Deggendorf (DE)

( * ) Notice: Subject to any disclaimer, the term of this patent is extended or adjusted under 35 U.S.C. 154(b) by 0 days.

(21) Appl. No.: 09/650,535

(22) Filed: Aug. 30, 2000

(30) Foreign Application Priority Data

Aug. 31, 1999 (DE) ..... 199 41 509

(51) Int. Cl.[7] ..... H01R 13/62
(52) U.S. Cl. ..... 439/320; 439/583; 439/460
(58) Field of Search ..... 439/320, 350, 439/351, 352, 449, 460, 583, 584, 585

(56) References Cited

U.S. PATENT DOCUMENTS 4,126,372 A * 11/1978 Hashimoto et al. ..... 439/583
4,580,865 A * 4/1986 Fryberger ..... 439/320
6,102,724 A * 8/2000 Ring ..... 439/320

FOREIGN PATENT DOCUMENTS

DE 19743212 2/1999

* cited by examiner

*Primary Examiner*—Tho D. Ta
(74) *Attorney, Agent, or Firm*—Sidley Austin, Brown & Wood, LLP

(57) ABSTRACT

A circular plug and socket connector is provided for producing electrical line connections and comprises a housing, accommodating and holding, in the region of one of its ends, an insulating base as a contact carrier and, in the region of its other end, a sealing cable lead-in and a covering cap, which makes a screwed connection with a second half of a covering ring of complementary configuration and is mechanically fixed to the housing. The housing has an overall cylindrical external periphery with at least one bearing surface assigned to the coupling ring and is overlapped, in part by the coupling ring and in part by a pot-shaped handle part having an opening in its bottom for the introduction of a cable.

5 Claims, 4 Drawing Sheets

CIRCULAR PLUG AND SOCKET CONNECTOR FOR PRODUCING ELECTRICAL LINE CONNECTIONS

FIELD OF THE INVENTION

The invention relates to a circular plug and socket connector for producing electrical line connections, consisting of a housing, accommodating and holding, in the region of its one end, an insulating base as a contact carrier and, in the region of its other end, a sealing cable lead-in, as well as, on the one hand, a coupling ring, which makes a screwed connection possible with a second plug and socket connector half of complementary construction and is mounted rotatably on the outer periphery of the housing and secured against being pulled off in the axial direction and, on the other hand, a covering cap fixed mechanically to the housing.

BACKGROUND OF THE INVENTION

Such a circular plug and socket connector, forming a component of a two-part plug and socket coupling, is known, for example, from the German Publication No. 197 43 212 and is distinguished essentially by a three-part construction. In this connection, a hollow, cylindrical housing, as a basic body forms the core of the plug and socket connector. The basic housing accommodates the contact carrier together with contact sleeves and is furthermore equipped with a clamping cage or a similar clamping means, which acts in the same way on the cable sheath of the cable that is to be introduced and prevents the cable from being pulled out. At the basic housing, on the one hand, an essentially pot-shaped covering cap, the bottom region of which has an inlet opening for a cable, is fastened, for example, over a clamping device. For the purpose of the intended attainment of a tension-proof connection between the basic housing, the covering cap and the cable sheath, the clamping device must be connected in a rigid manner with the basic body, so that the connection can no longer be undone, at least from the outside, after the installation. Adjacent to the covering cap, an overlapping coupling ring, the end face of which is assigned to the contact carrier, is mounted rotatably on a cylindrical jacket-shaped outer surface of the basic body of the plug and socket coupling. The function of the coupling ring is to produce a tension-resistant connection between one half of the plug and socket coupling and a second half of the plug and socket coupling of a complementary configuration. Due to the relatively large axial longitudinal extent of the covering cap in the case of such a construction of a plug and socket connector coupling, only a relatively small axial length can be provided for the coupling ring. Such an arrangement results in problems relating to the handling of the plug and socket connector coupling, especially in the service area. Since plug and socket connector couplings of this type have to be frequently opened and closed under extremely spatially limited conditions, the short length of the coupling ring, which must be loosened or tightened for the opening or closing of the coupling ring, presents the problem that such loosening or tightening can only be carried out by partial rotations, thus, making the procedure very tedious. This problem is not limited exclusively to the configuration of a plug and socket connector coupling secured by means of a coupling ring as mentioned here, but also arises in all cases, where a coupling ring is used to secure a plug and socket connector coupling.

SUMMARY OF THE INVENTION

It is an object of the invention to improve a circular plug and socket connector of the construction described above so that, while adequate strain relief for the cable is retained, adequate sealing of the housing against moisture and ease of installation and service of the plug and socket connector coupling are improved so that the aforementioned disadvantages are eliminated.

Pursuant to the invention, this objective is accomplished due to the fact that the housing has an overall cylindrical external periphery with at least one bearing surface assigned to the coupling ring and is overlapped, in part by the coupling ring and in part by a pot-shaped handle part having an opening in its bottom for the introduction of a cable. By these means, the housing is enveloped completely, on the one hand, by the coupling ring and, on the other, by the handle part, from which the possibility arises of enlarging the handle surface, available for manipulating the coupling ring, so that the handle surface for manipulating the coupling ring can be extended to the full axial length of the circular plug and socket connector. This ensures that the improvement in the installation and ease of service of the plug and socket connector are achieved.

On the other hand, however, it should be possible to produce the inventive circular plug and socket connector technically and economically. For this reason, it is necessary to pay attention especially to the fact that the assembly of the circular plug and socket connector must be simple and not time consuming.

In this connection, the invention provides that the handle part be connected with the coupling ring, so that it can be rotated at least indirectly, is supported at the housing and can be detached. A detachable connection between the handle part and the coupling ring makes it possible to introduce the contact carrier, the strain relief for the cable, adequate sealing against moisture and other components for the housing from one side and consecutively into the housing and subsequently to connect the handle part with the coupling ring. The detachability of the connection between the handle part and the coupling ring furthermore has the advantage for carrying out maintenance or supplementary work or when changing the contact position and the like, that this service work can be carried out with the least possible expenditure of time and repeated as often as necessary.

In a preferred embodiment, the handle part and the coupling ring are connectable together over positively interacting means formed or disposed alternately at the handle part and at the coupling ring. For the voluntary introduction and loosening of the connection between the coupling ring and the handle part, one of the two mutually positively interacting means is shifted into a loosening position.

In accordance with a particularly easily realizable and operationally safe configuration of this embodiment, the handle part has two snap-in hooks, which are disposed opposite to one another and protrude over the end face of the handle part facing the coupling ring. Window recesses of complementary configuration are assigned as abutments to the snap-in hooks in the periphery of the coupling ring.

Using conventional and proven means for supporting and securing the coupling ring at least partially, it is furthermore provided in a further embodiment that the coupling ring be secured against being pulled off in the axial direction by means of a collar, pointing radially inward and supported at the end face of the housing and a retaining ring, disposed at a distance from the collar, and that the snap-in hooks, connecting the handle part with the coupling ring, grips under the retaining ring when the coupling ring and the handle part are connected together.

With respect to equipping the housing of the circular plug and socket connector with a seal, which controls the introduction of the cable and contacts the cable sheath forming a seal, and with at least one strain relief engaging the cable sheath, an advantageously realizable mode of configuration or arrangement arises out of the fact that a cable feed-through which a seal, which is connected to the cable feed-through and adjoins the cable, is used in the end of the housing opposite to the contact carrier, and that the cable feed-through, together with the connected seal, is fixed to the housing by means of a fastening clip placed upon the outside of the housing.

In an advantageous development of such a mode of configuration or arrangement, provisions can then furthermore advantageously be made so that the fastening clip embraces a collar of the housing, deposited radially towards the outside and, over a portion of its external extent, forming a bearing support for the handle part of the circular plug and socket connector.

Further advantageous configuration possibilities arise, first of all, with regard to the mounting and support of the handle part at the housing of the circular plug and socket connector, due to the fact that the pot-shaped handle part has a radial expansion of its inner periphery in the region of its fastening clip forming its overlapping with its support. A simplification in the sense of a reduction in the number of components of the circular plug and socket connector, which are required and must be installed individually, can furthermore be attained due to the fact that the fastening clip is constructed in one piece with a clamping cage for the strain relief of the cable.

The various features of novelty which characterize the invention are pointed out with particularity in the claims annexed to and forming a part of this disclosure. For a better understanding of the invention, its operating advantages and specific objects attained by it use, references should be had to the drawings and description matter in which there are illustrated and described preferred embodiments of the invention.

BRIEF DESCRIPTION OF THE DRAWINGS

The invention is described in detail below with reference to the drawings, in which.

DESCRIPTION OF THE PREFERRED EMBODIMENTS

Figure 1:
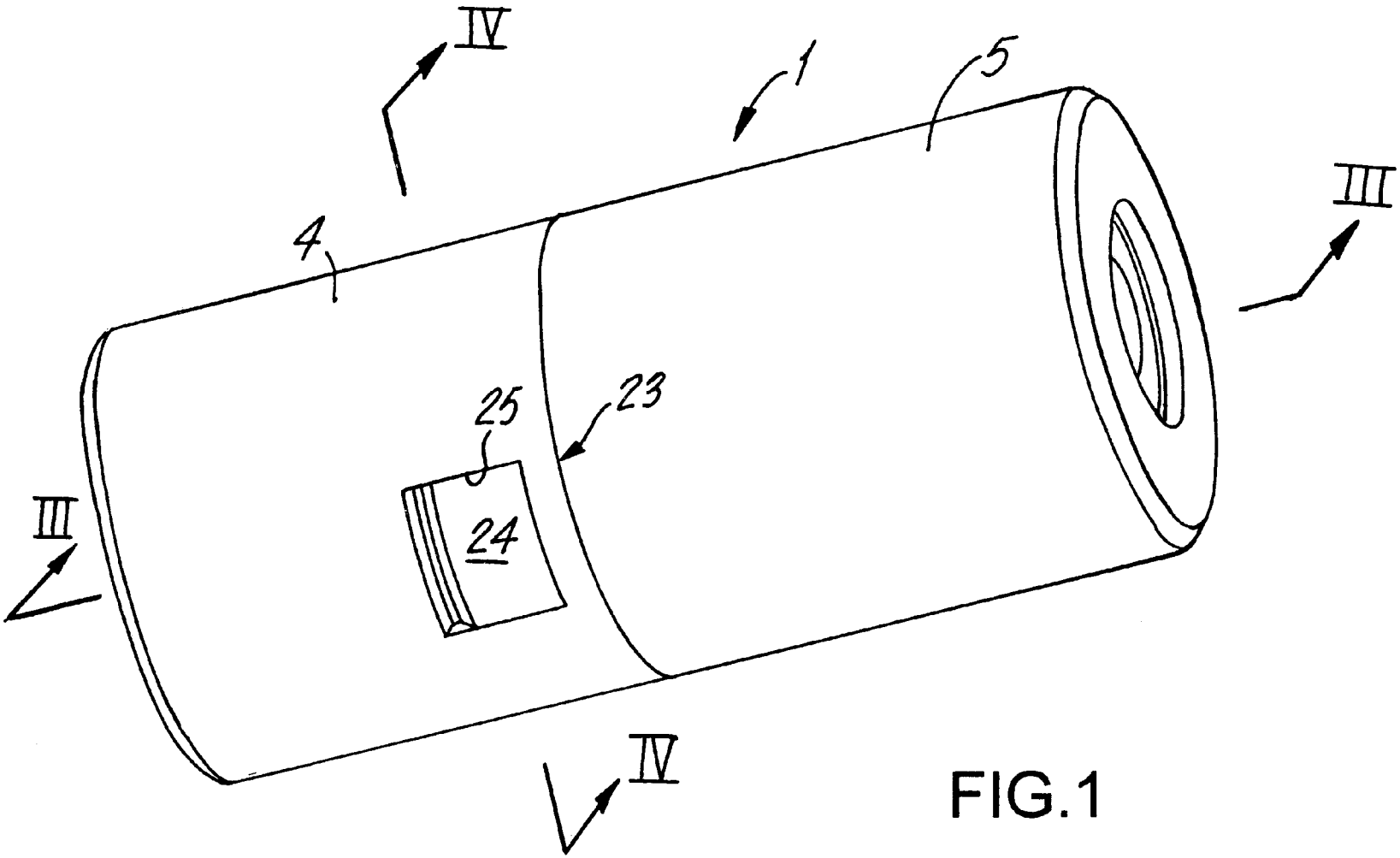
FIG. 1 shows a diagrammatic representation of a circular plug and socket connector.
Figure 2:
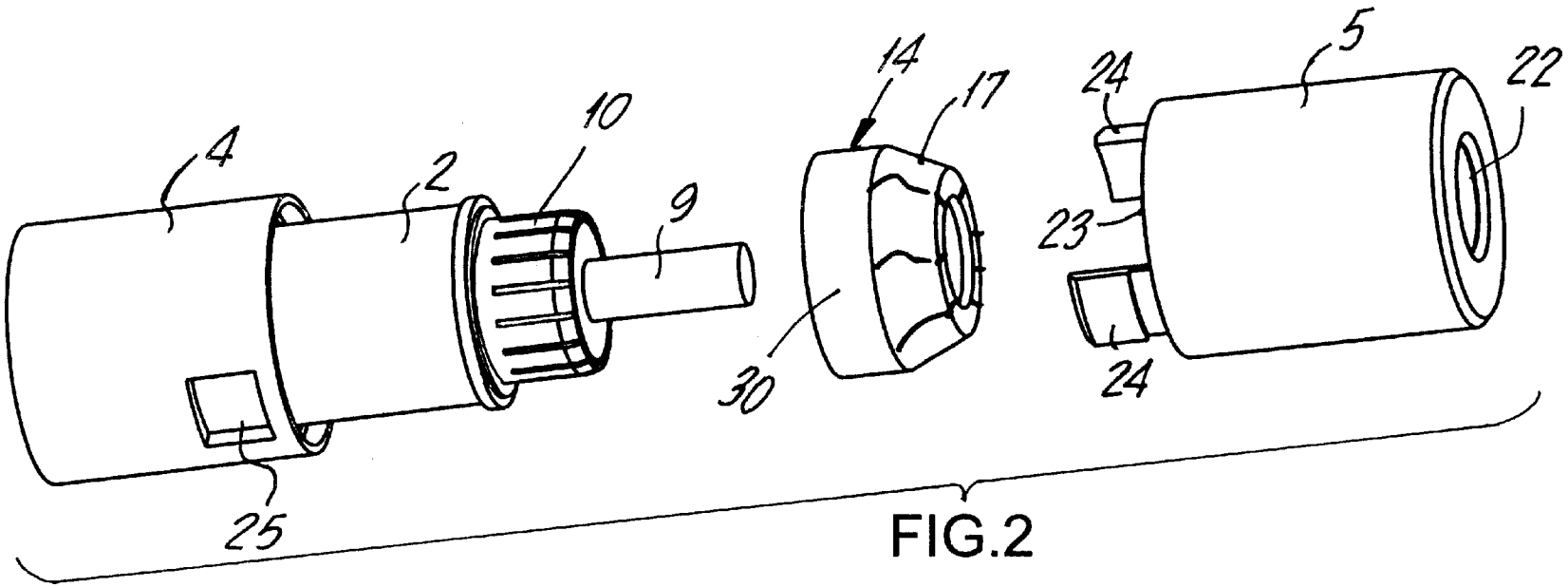
FIG. 2 shows an exploded representation of a circular plug and socket connector of FIG. 1
Figure 3:
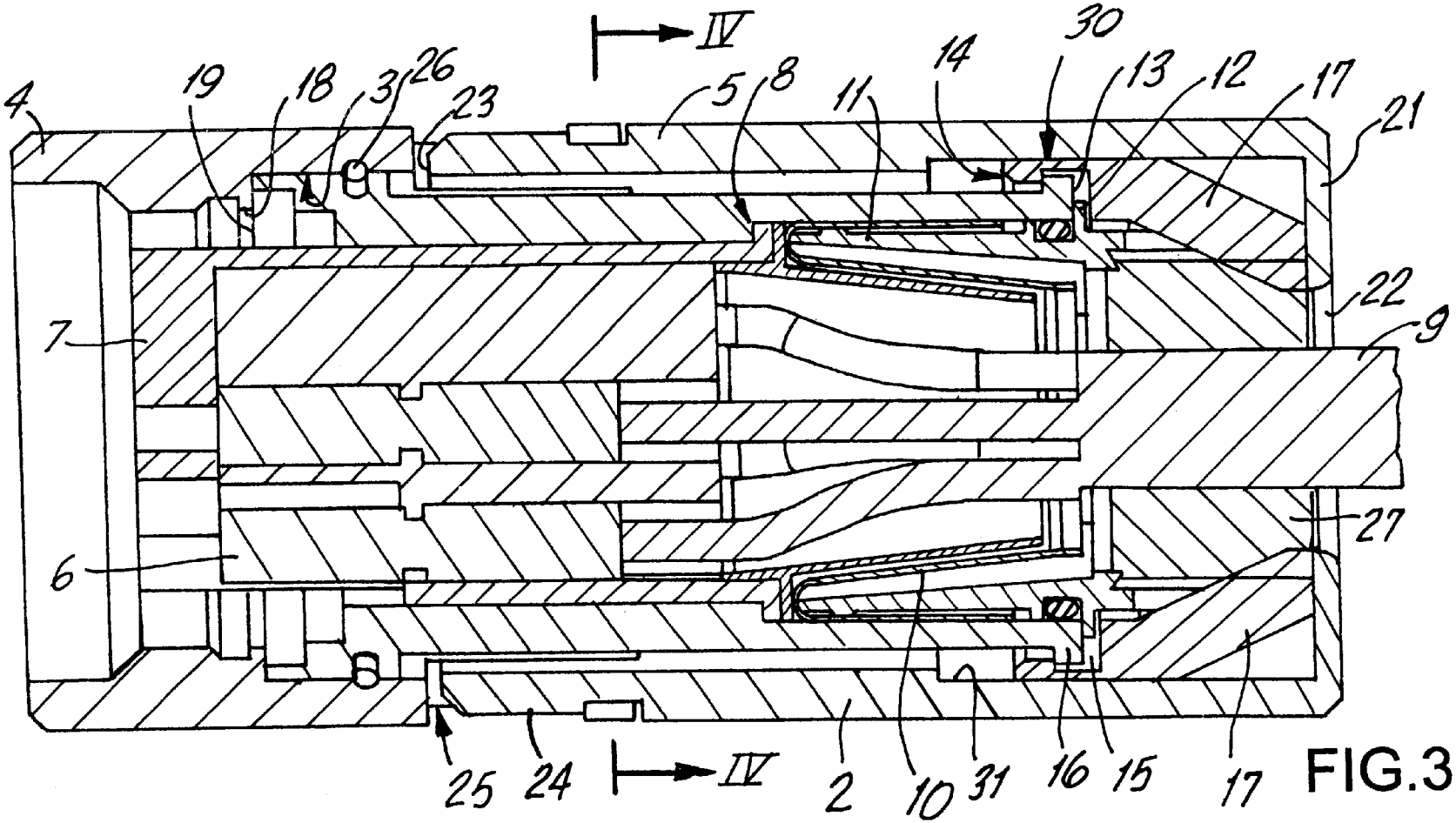
FIG. 3 shows a longitudinal section through the circular plug and socket connector of FIG. 1.
Figure 4:
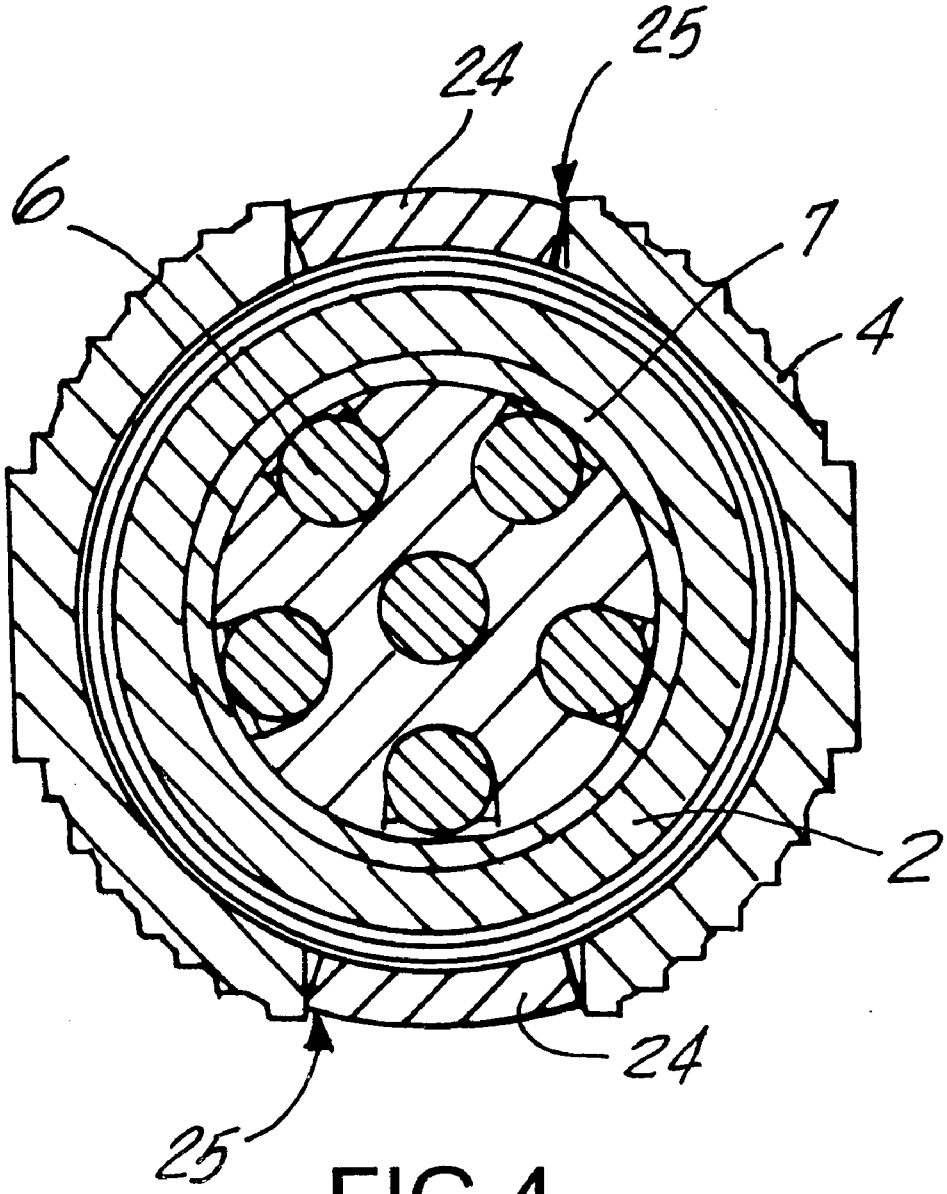
FIG. 4 shows a section taken along line IV—IV in FIG. 1.

The embodiment of a circular plug and socket connector 1, shown in the drawing, comprises, a housing 2, which forms the carrying part of the whole circular plug and socket connector 1, a coupling ring 4, rotatably mounted at a cylindrical peripheral surface 3 of the housing 2 and overlapping a first partial region of the total axial length of the housing and a handle part 5, overlapping a second partial region of the total axial length of the housing 2 of the circular plug and socket connector. In the one end region of the housing 2, formed essentially as a cylindrical hollow or tubular body, a two-part contact carrier 7, equipped with contacts 6, is fixed by means of a collar arrangement 8. Preceding the contact carrier 7 in the inlet direction of the cable 9, a contacting 10 for a cable shielding, which is optionally present but not shown in the drawing, may be provided. In its length within the housing 2 of the circular plug and socket connector 1, the contacting 10 for the cable shielding is held by means of a supporting element 11. The supporting element 11 lies, on the one hand, over a radial collar 12 against the end side 13 of the housing 2 and, on the other, against the inner rear side and engages the collar arrangement 8 for fixing the contact carrier 7 in the housing 2. In its effective position, the supporting element 11 is held by means of a fastening clip, generally labeled 14. The fastening clip 14, by means of an annular groove 15 in its inner periphery, embraces a collar 16 of the housing 2 of the circular plug and socket connector 1, which collar 16 is placed radially towards the outside and, with that, forms an abutment. In this way, the fastening clip 14, supports all the aforementioned components 7, 10 and 11 of the circular plug and socket connect or 1 at the housing 2. On the other hand, the fastening clip 14 has cage-shaped and mutually converging clamping arms 17, which engage a seal lying against the sheath of the cable 9 and, in this way, exert a clamping force on the cable sheath, which clamping force forms a strain relief for the contact connections within the circular plug and socket connector. The clamping arma have corresponding outer bearing surfaces 30 which provide support for the handle part 5. The handle part 5 has, in its region overlapping the fastening clip 14, a radial expansion 31 of its inner periphery. The coupling ring 4, rotatably mounted on a peripheral cylindrical surface 3 of the housing 2, is supported, on one hand, by a radial, inwardly directed collar 18 at the front end surface 19 of the housing 2 in the contacting direction and, on the other, in the pull-out direction by means of a retaining ring 26 against the housing 2 of the circular plug and socket connector 1. In its bottom 21, the overall pot-shaped handle part 5 has an opening 22 for introducing the cable 9 into the housing 2 of the circular plug and socket connector 1. At its end face 23, facing the coupling ring 4, the handle part 5, which is constructed sleeve-shaped over the remainder of its longitudinal extent, is equipped with two snap-in hooks 24, which protrude beyond its end face 23 in the axial direction and to which window recesses 25 are assigned as abutments in the periphery of the coupling ring 4. To loosen the coupling between the handle part 5 and the coupling ring, the snap-in hooks 24 can manually be shifted radially inwards in such a manner, that they become disengaged from the window recesses 25 of the coupling ring 4.

What is claimed as new and desired to be protected by letters patent is set forth in the appended claims:

What is claimed is:

1. A connector half of a circular plug and socket connector, comprising a housing having first and second end regions; a contact carrier arranged in the first end region; a sealing cable lead-in arranged in the second end region; a coupling ring rotatably mounted on an outer periphery of the housing in an area of the first end region for connecting the connector half with another connector half of the circular plug and socket connector, the coupling ring surrounding a first region of a longitudinal extent of the housing; means for preventing axial displacement of the coupling ring relative to the housing; a pot-shaped handle part rotatably mounted on the outer periphery of the housing and surrounding a second region of the longitudinal extent of the housing, the pot-shaped handle part having a bottom provided with an opening through which a cable is introduced into the housing; a fastening clip located in the housing for securing the cable therein and having outer bearing surface means for supporting the handle part on the housing; and means for releasably connecting the handle part with the coupling ring.

2. A connector half of claim 1, wherein the releasably connecting means comprises two snap-in hooks provided on end face of the handle part facing the coupling ring, and abutment means provided on a peripheral surface of the coupling ring and formed as window recesses having a shape complementary to the snap-in hooks.

3. A connector half of claim 1, wherein the pot-shaped handle part has, in a region thereof overlapping the fastening clip, a radial expansion of an inner periphery cooperating with the bearing surface means of the fastening clip.

4. A connector half of claim 1, wherein the fastening clip is formed as a one-piece part with a clamping cage for strain relief of the cable.

5. A connector half of claim 4, wherein the clamping cage has a plurality of converging clamping arms for securing the sealing lead-in in the housing.

* * * * *